United States Patent [19]

Booth

[11] 3,983,800

[45] Oct. 5, 1976

[54] DOUBLE-ACTING CAN CRUSHER

[76] Inventor: Claude B. Booth, 4982 Meadowview, Wichita, Kans. 67216

[22] Filed: Oct. 6, 1975

[21] Appl. No.: 619,590

[52] U.S. Cl. ..... 100/215; 74/57; 100/DIG. 2; 100/209; 100/292

[51] Int. Cl.[2] ..... B30B 15/30; B30B 1/26

[58] Field of Search ..... 100/DIG. 2, 289, 292, 100/186, 215, 209; 74/57, 58; 241/99

[56] References Cited

UNITED STATES PATENTS

| | | | |
|---|---|---|---|
| 47,591 | 5/1865 | Wilber | 100/209 |
| 1,766,224 | 6/1930 | Montevaldo | 74/58 |
| 2,002,993 | 5/1935 | Ehrick et al. | 100/209 X |
| 3,421,397 | 1/1969 | Clark | 100/292 X |
| 3,659,520 | 5/1972 | Garrett | 100/292 X |

*Primary Examiner*—Billy J. Wilhite
*Attorney, Agent, or Firm*—William S. Dorman

[57] ABSTRACT

A double-acting can crusher comprising a frame, a shaft rotatably mounted in the frame, a substantially cylindrical sheath extending horizontally above the shaft in parallel relation thereto, a pair of spaced cylindrical crushing blocks mounted at the horizontal ends of the sheath, a substantially rectangular upper opening extending along the top portion of the sheath and being sufficiently wide to permit the passage of uncrushed cans into the sheath, a lower opening in the sheath extending longitudinally below the upper opening, the lower opening being sufficiently wide at the ends thereof to permit the passage of crushed cans therethrough but being sufficiently narrow in the central or major portion thereof to prevent the passage of uncrushed cans therethrough, a collar mounted on the shaft for movement back and forth along the shaft, an endless reverse helical groove on the shaft, a pin freely received in a hole in the collar and disposed at right angles to the shaft, an arcuate tongue on the pin received within the helical groove, a two-sided cylindrical ram mounted for to and fro horizontal movement within the sheath towards and away from each of the blocks, the ram being connected to the collar, a motor for rotating the shaft whereby the collar will move back and forth along the shaft in response to the rotary motion thereof, thereby moving the ram alternately towards and away from each of the blocks, and a hopper mounted on the frame disposed above the sheath for directing cans to be crushed into the upper rectangular opening in the sheath.

3 Claims, 7 Drawing Figures

DOUBLE-ACTING CAN CRUSHER

BACKGROUND OF THE INVENTION

1. Field of the Invention

This invention relates to a device for crushing cans, such as beer cans, pop cans, and the like, and, more particularly, to a can crusher which is double-acting in the sense that a can can be crushed at both ends of the path of movement of a two-sided ram.

2. Description of the Prior Art

Many devices have been built and/or proposed for crushing cans. For the most part, however, these can crushers are inefficient and slow in operation.

SUMMARY OF THE INVENTION

The present invention involves a double-acting can crusher which includes a frame and a shaft rotatably mounted in the frame. Above the shaft is a horizontally extending and substantially cylindrical sheath or shroud which is arranged in parallel relation with the shaft. A crushing block is mounted in each end of the cylindrical sheath. An upper horizontally extending opening is provided in the sheath to permit the passage of uncrushed cans into the sheath. Thus, the upper rectangular opening is formed by an upper rear edge and an upper front edge which is spaced in parallel relation to the upper rear edge and at a distance therefrom sufficiently great to permit the passage of uncrushed cans into the sheath. A lower opening is also provided in the sheath disposed below the upper opening. However, the lower opening is sufficiently narrow, along a major portion thereof, to prevent the passage of uncrushed cans through this opening. Nevertheless, the lower opening is sufficiently wide adjacent the ends thereof to permit the passage of crushed cans through the lower opening. A collar is mounted on the shaft for movement back and forth along the shaft. The collar is provided with an endless reverse helical groove which is similar to the type of groove provided on the winding shafts for fishing reels. A pin is freely received in a hole in the collar and is disposed at right angles to the shaft. The pin is provided with an arcuate tongue at the lower end thereof which is received in the helical groove. The outer end of the shaft, at one end thereof, is provided with a large pinion gear which meshes with a smaller pinion gear on a motor which is mounted on the frame. A ram which is substantially cylindrical and which has two flat sides is mounted for movement within the sheath. The ram is connected to the collar. Thus, as the motor rotates the shaft, the collar will move back and forth along the shaft in response to the rotary motion thereof and the ram will move towards and away from each of the blocks. Therefore, if a can were passed into the sheath through the upper opening, depending upon which side of the ram it was on, it would be crushed between the ram and the adjacent block upon the next movement of the ram towards that block. A hopper is also mounted on the frame above the upper rectangular opening for directing cans to be crushed into the upper rectangular opening in the sheath.

DESCRIPTION OF THE PREFERRED EMBODIMENT

Figure 1:
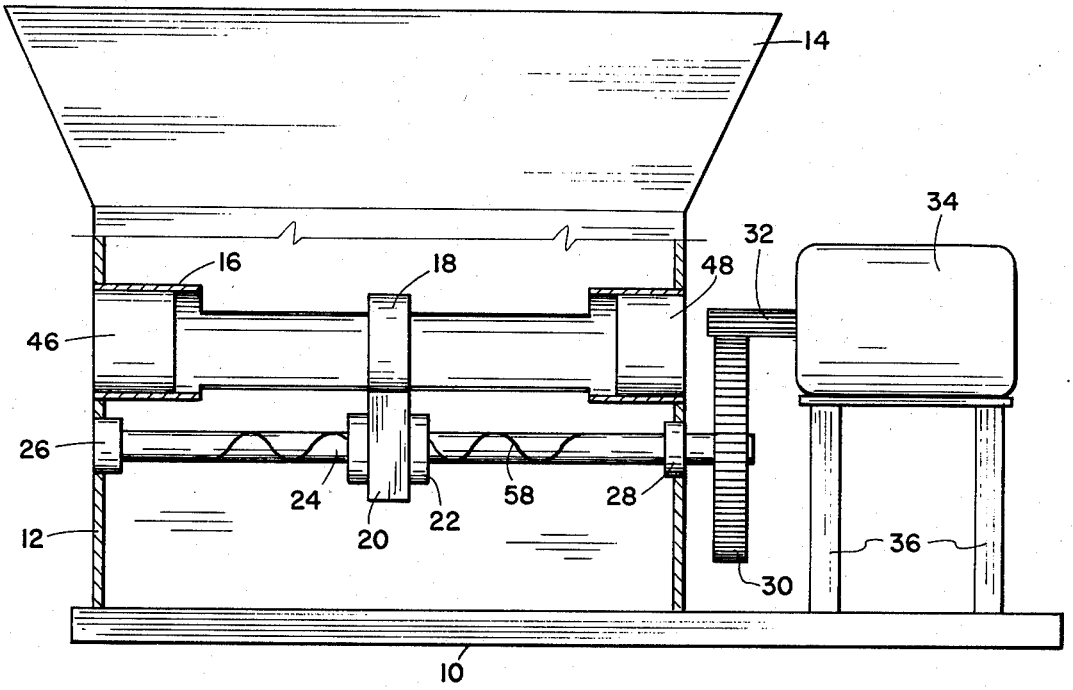
FIG. 1 is a front view, with some portions in section, of the double-acting can crusher constructed in accordance with the present invention.

Referring to FIG. 1, the can crusher includes a frame 10 upon which is mounted a substantially rectangular housing 12. At the top of the housing is a hopper 14 for directing uncrushed cans into the device, as will hereinafter appear. Within the housing 12, and below the hopper 14, is mounted a cylindrical shroud or sheath 16, and a cylindrical ram 18, which will sometimes be referred to herein as a two-sided ram, is mounted for longitudinal movement within the sheath 16. The ram 18 is provided with a lower rectangular portion 20 which connects with a collar 22 by means of the set screw 50. The collar 22 is mounted on the shaft 24, the latter being supported within the housing 12 by left-hand bearing 26 and right-hand bearing 28. The right-hand projecting end of the shaft 24 is provided with a large pinion gear 30 which meshes with a smaller pinion gear 32 on a motor 34. The motor 34 is mounted on upright supports 36 which connect with the base or frame 10.

The sheath 16 is provided with an upper rectangular opening formed by a longitudinally extending rear edge 38 and a longitudinally extending forward edge 39 which is spaced apart from the rear edge 38 in parallel relation and at a sufficient distance to permit the passage of uncrushed cans, such as beer cans, pop cans, and the like, through the upper rectangular opening into the shroud or sheath 16.

Figure 2:
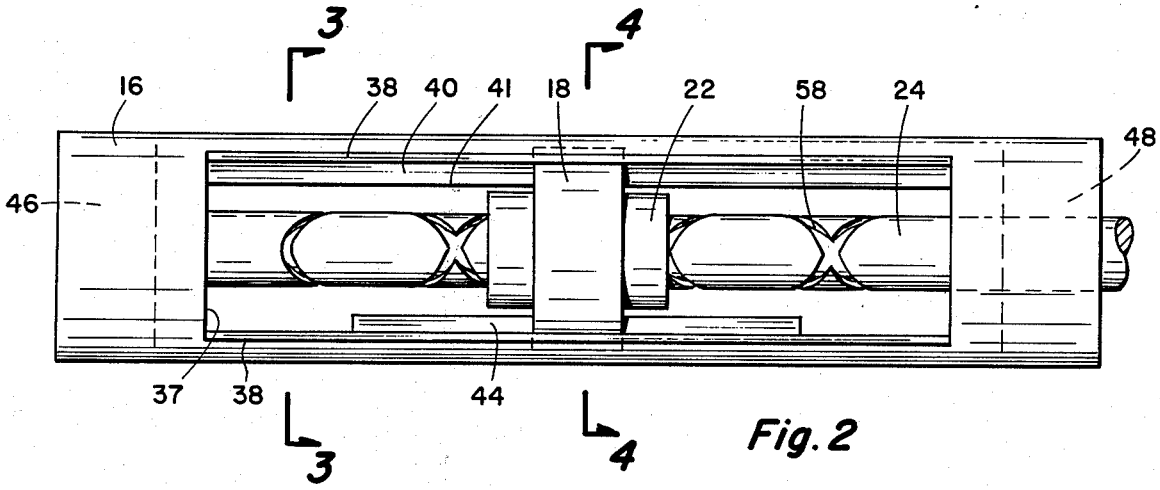
FIG. 2 is a plan view of the sheath and associated structure shown in FIG. 1.
Figure 5:
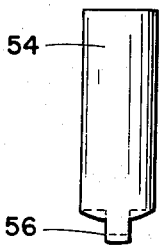
FIG. 5 is an end view, on an enlarged scale, of the pin shown in FIG. 4.
Figure 6:
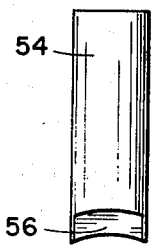
FIG. 6 is a front view of the pin shown in FIG. 5.
Figure 7:
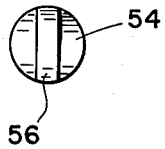
FIG. 7 is a bottom view of the pin shown in FIGS. 5 and 6.
Figure 3:
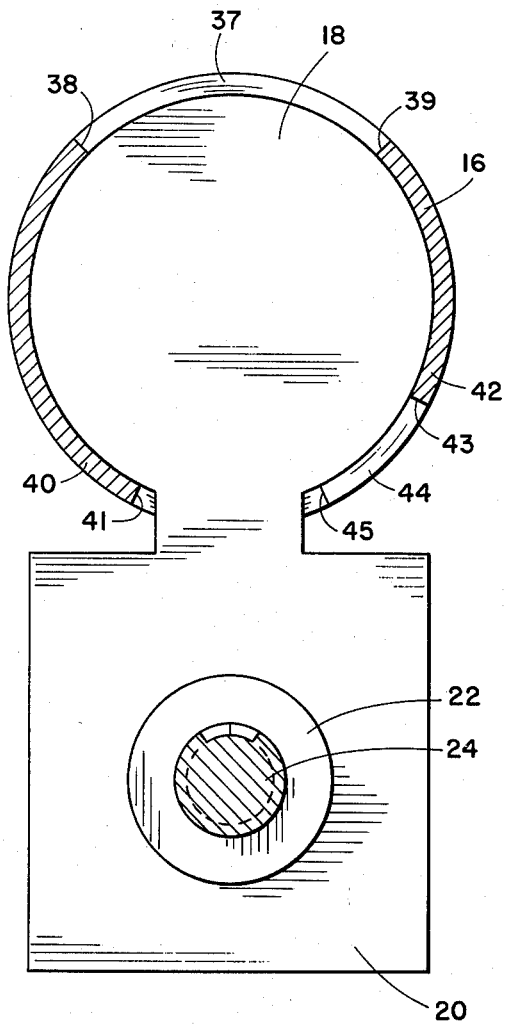
FIG. 3 is a section view, on an enlarged scale, taken along section line 3—3 of FIG. 2.
Figure 4:
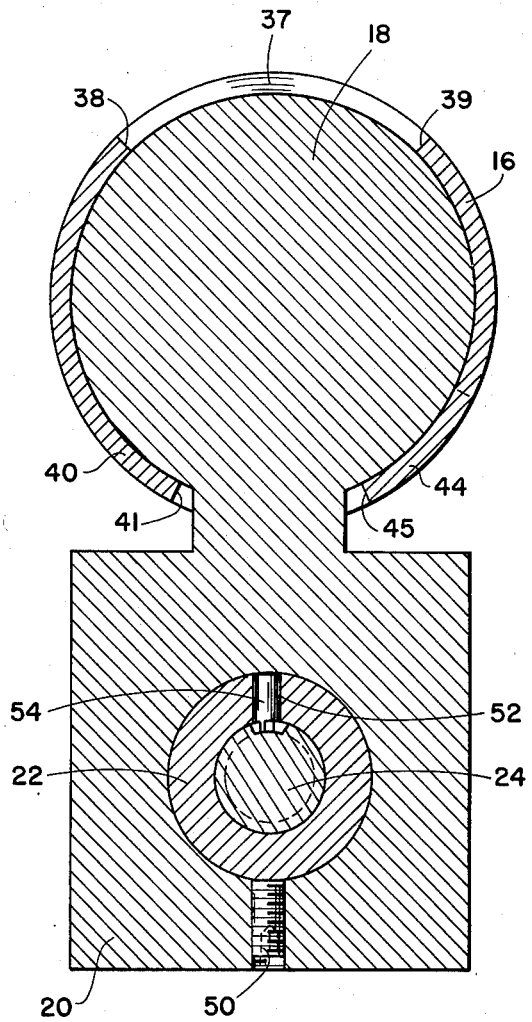
FIG. 4 is a section view, on an enlarged scale, taken along section line 4—4 of FIG. 2.

Disposed below the uppper rectangular opening 37 is a lower opening formed by a lower rear lip 40 which is defined by the lower rear edge 41 located below the upper rear edge 38 (see FIG. 3). The forward portion of the lower opening is defined by a pair of lower forward portions at the end of this opening as defined by the lower edges 43 (see FIG. 3). The central portion of the lower opening, however, is provided with a downwardly and rearwardly extending lip 44 defined by the lower edge 45 (see FIG. 4). As shown in FIG. 2, this lip 44 extends for a substantial portion of the length of the shroud so that an uncrushed can would be unable to pass through the lower opening. However, it should be apparent that the end portions of the lower opening formed by the lips 42 as defined by the edges 43 are sufficiently wide to permit crushed cans to pass through the lower opening at the ends thereof.

A pair of substantially cylindrical blocks 46 and 48 are mounted in the left-hand and right-hand ends, respectively, of the shroud 16 within the frame 12. Thus, the cans are actually crushed between either block and the adjacent side of the two-sided ram 18.

In order to provide the desired reciprocating movement for the ram 18, the collar 22 (see FIG. 4) is provided with a radial opening 52 which is substantially at right angles to the shaft 24. A pin 54 is loosely received within the hole 52 so that it can turn for a purpose which will hereinafter appear. The lower end of the pin 54 is provided with an arcuate tongue 56 which is received within a helical recess 58 in the shaft 24. This helical recess can be defined as an endless reverse helical groove which is generally of the same type as used on the winding screws for fishing reels and which operates the device that moves the line back and forth across the fishing reel as the line is wound in.

In operation, the motor 34 is connected with a source of power and the ram 18 is, thereby, caused to move back and forth within the sheath 16 towards and away from the crushing blocks 46 and 48. If a can, such as a beer can or pop can, for example, were now dropped into the hopper 14 it would pass through the rectangular opening 37 onto one side or the other of the two-sided ram 18. On the next movement of the ram 18 towards the block between which the can was located, the can would be crushed and the crushed can would be permitted to fall through the end of the lower opening in the sheath. Since the action of the ram 18 is two-fold, it will crush a can in moving in either direction and, thus, its operation will be very rapid. Of course, the front side or rear side of the hopper 12 can be opened to prevent the buildup of crushed cans within the housing 12.

What is claimed is:

1. A double-acting can crusher comprising a horizontally extending elongated sheath having a pair of spaced blocks mounted at the horizontal ends of said sheath, a two-sided ram mounted for to and fro horizontal movement within said sheath towards and away from each of said blocks, a substantially rectangular upper opening extending along the top portion of said sheath above said ram and being sufficiently wide to permit the passage of uncrushed cans into said sheath, a lower opening in said sheath extending longitudinally below said upper opening, said lower opening being sufficiently narrow to prevent the passage of uncrushed cans therethrough, said lower opening being sufficiently wide adjacent the ends thereof to permit the passage of crushed cans therethrough, means for moving said ram alternately towards and away from each of said blocks, and a hopper disposed above said sheath for directing cans to be crushed into said upper rectangular opening in said sheath.

2. A double-acting can crusher as set forth in claim 1 wherein said sheath is substantially cylindrical. wherein said upper opening is formed by a longitudinally extending upper rear edge, a longitudinally extending upper front edge spaced apart from said upper rear edge at a sufficient distance to permit the passage of uncrushed cans into said sheath, and a pair of interconnecting end edges adjacent said blocks and wherein said lower opening is provided with end areas substantially as wide as said upper opening, but wherein said lower opening is provided with a downwardly and centrally extending lip for preventing the passage of uncrushed cans through said lower opening.

3. A double-acting can crusher as set forth in claim 2 wherein said sheath is mounted in a frame, a shaft rotatably mounted in said frame below said sheath and in parallel relation thereto, a collar mounted on said shaft for movement back and forth along said shaft, an endless reverse helical groove on said shaft, a pin freely received in a hole in said collar and disposed at right angles to said shaft, an arcuate tongue on said pin received within said helical groove, said ram being cylindrical and being mounted on said collar, means for rotating said shaft whereby said collar will move back and forth along said shaft in response to the rotary motion thereof for moving said ram alternately towards and away from each of said blocks, said hopper being mounted on said frame above said upper opening.

* * * * *